United States Patent [19]

Velezis

[11] Patent Number: 5,027,541

[45] Date of Patent: Jul. 2, 1991

[54] MAGAZINE LOADED FIREARM

[76] Inventor: George A. Velezis, 175 Skyline Dr., Middlebury, Conn. 06762

[21] Appl. No.: 375,835

[22] Filed: Jul. 5, 1989

[51] Int. Cl.[5] ..... F41A 9/00

[52] U.S. Cl. ..... 42/18

[58] Field of Search ..... 42/18

[56] References Cited

U.S. PATENT DOCUMENTS

| | | | |
|---|---|---|---|
| 501,192 | 7/1893 | Pitcher . | |
| 3,365,830 | 1/1968 | Vartanian et al. | 42/16 |
| 3,399,479 | 9/1968 | Goldstein . | |
| 4,864,758 | 9/1989 | Crossman . | |
| 4,867,039 | 9/1989 | Dobbins . | |

*Primary Examiner*—Deborah L. Kyle
*Assistant Examiner*—Richard W. Wendtland
*Attorney, Agent, or Firm*—McCormick, Paulding & Huber

[57] ABSTRACT

A pump action shotgun loaded from a magazine tube has a box magazine which feeds successive rounds of ammunition into the magazine tube through an opening in the side of the tube. Each successive round of ammunition is fed from the magazine tube into the receiver of the gun by a plunger connected by a rack and pinion mechanism to an action bar which moves the breech bolt between its retired and battery positions. The rack and pinion mechanism maintains the plunger out of the path of a round of ammunition fed into the magazine tube from the box magazine when the breech bolt is in its battery position and moves the plunger through a distance greater than the distance between the retired and battery positions to move a round of ammunition from the magazine tube into the receiver when the breech bolt moves from its battery to its retired position. The box magazine is adjustable to accommodate shells of differing lengths.

11 Claims, 3 Drawing Sheets

MAGAZINE LOADED FIREARM

BACKGROUND OF THE INVENTION

This invention relates in general to firearm loading apparatus and deals more specifically with improvements in magazine tube loaded firearms, particularly shotguns.

Shotguns of magazine tube loaded type have a long record of proven dependability and are widely used by sportsmen. However, such firearms have gained only limited acceptance by law enforcement agencies and the military, because of the time required for reloading.

It is the general aim of the present invention to provide an improved firearm of the type having an action particularly adapted for loading from a magazine tube and which employs a box type magazine to facilitate rapid loading and increase firepower.

SUMMARY OF THE INVENTION

The present invention is concerned with improvements in a firearm having a receiver, a barrel projecting forwardly from the receiver and including a bore communicating with the interior of the receiver, a bolt supported in the receiver for movement between open and closed position, bolt actuating means connected to the bolt for moving the bolt between its open and closed positions, a magazine tube projecting forwardly from the receiver in generally axially parallel relation to the barrel and having a tubular bore communicating with the interior of the receiver, a plunger within the magazine tube for biasing a round of ammunition contained within the magazine tube rearwardly therealong and toward and into the receiver. An ammunition receiving opening through the wall of the magazine tube forward of the receiver, and means for releasably securing a box magazine in fixed relation to the magazine tube to feed a round of ammunition along a predetermined path through the ammunition receiving opening into the magazine tube and to a ready or loading position wherein the round of ammunition is generally coaxially aligned with the magazine tube. In accordance with the present invention an accelerating means which includes a set of racks and a set of overdrive gears is connected to the plunger and to the bolt actuating means for maintaining the plunger in a position forward of the ready position when the bolt is in its closed position and for moving the plunger through a distance greater than the distance traveled by the bolt in response to operation of said bolt actuating means.

DETAILED DESCRIPTION OF PREFERRED EMBODIMENT

Figure 1:
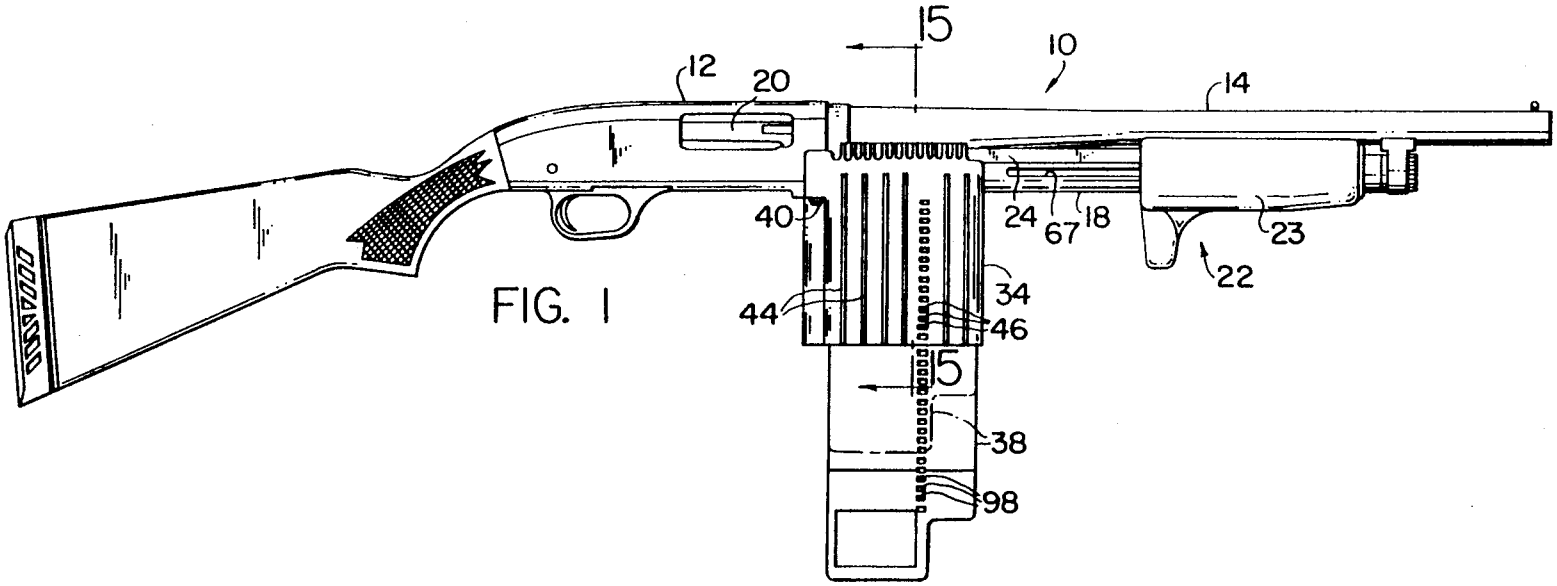
FIG. 1 is a side elevational view of a shotgun embodying the present invention.

Turning now to the drawings, a firearm or shotgun embodying the present invention is indicated generally by the reference numeral 10. The illustrated shotgun 10 is a modified MOSSBERG Model 500 pump action shotgun, manufactured and marketed by O.F. Mossberg & Sons, Inc., North Haven, Conn. Since the basic gun 10 is of a well-known type, only those parts of the gun essential to an understanding of the invention will be described in detail.

Further referring to the drawings, the gun 10 has a receiver 12 and a barrel 14 which projects forwardly from the receiver and includes a bore which communicates with the interior of the receiver. A magazine tube 18 projects forwardly from the receiver in generally axially parallel relation to the barrel and also communicates with the interior of the receiver. A breech bolt 20, supported within the receiver 12 for reciprocal sliding movement between battery and retired positions, is connected to a bolt actuating mechanism, indicated generally at 22, which includes a manually moveable forearm 23 and an action bar assembly 24 connected to the forearm 23 and to the breech bolt 20. A plurality of rounds of ammunition or shells are usually stored within the magazine tube 18 of the unmodified gun and urged in the direction of the receiver by a plunger assembly indicated generally at 26 which includes a plunger 28 and a plunger spring 30, all of which is well-known in the shotgun art.

When the action is opened by manually moving the forearm 23 in a rearward direction toward the receiver 12 the action bar 24 moves the breech bolt 20 to its retired or open position causing an elevator (not shown) to move to a shell receiving position and releases a shell interrupter and a shell stop, located within the receiver but not shown, which allow the shell to move from the magazine tube into the receiver and to a loading position in response to biasing force applied to the shell by the plunger assembly 26. Return movement of the forearm 23 in forward direction causes the shell interrupter to arrest rearward movement of the next successive shell in the magazine tube 18 to prevent it from entering the receiver 12 while the elevator moves the shell within the receiver from its loading position into the path of the returning breech bolt 20 whereby the shell is chambered by the breech bolt as the breech bolt moves into battery position in an manner well known in the shotgun art.

In accordance with the present invention, the modified shotgun 10 is loaded from a box type magazine and has an ammunition or shell receiving opening 32 through the sidewall of the magazine tube 18 immediately forward of the receiver 12. A magazine shroud 34 mounted in fixed position relative to the magazine tube and has an magazine well opening 36 therethrough in general registry with the shell receiving opening 32. The magazine shroud 34 is adapted to receive a box magazine 38 for containing a plurality of shotgun shells S,S, releasing each shell in succession and biasing the released shell through the shell receiving opening 32 and to a ready position within the magazine tube 18 wherein the shell is generally coaxially aligned with the magazine tube. Since only one shell is disposed within the magazine tube 18 at any given time, a shell interrupter is not a required element of the improved firearm 10 and is not included as part of the improved structure.

Further, and in accordance with the invention, the plunger assembly 26 is connected to the bolt actuating mechanism, or more specifically to the action bar assembly 24, which maintains the plunger assembly 26 in a position forward of the ready position when the breech bolt 20 is in its battery position and which moves the plunger assembly in the direction of the receiver 12 to bias a shell from the ready position into the receiver and to a loading position therein when the bolt actuating mechanisms is operated to move the breech bolt from its battery position to its retired position, all of which will be hereinafter more fully discussed.

Figure 5:
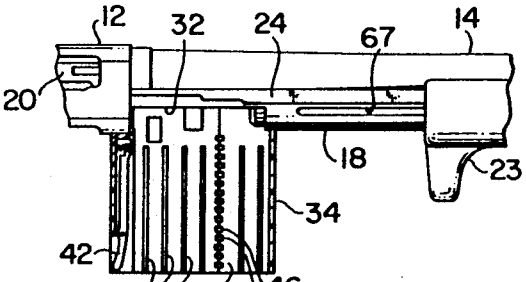
FIG. 5 is a fragmentary sectional view similar to FIG. 1 but showing the magazine shroud in longitudinal section with the magazine removed therefrom.
Figure 13:
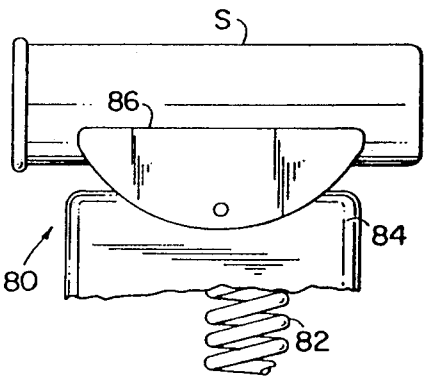
FIG. 13 is a somewhat enlarged fragmentary side elevational view of the magazine follower.
Figure 14:
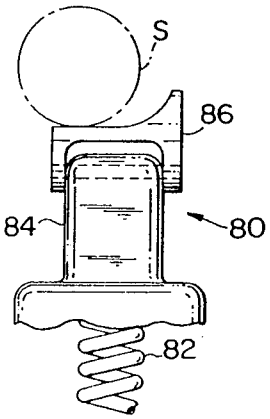
FIG. 14 is a fragmentary front elevational view of the magazine follower shown in FIG. 13.
Figure 11:
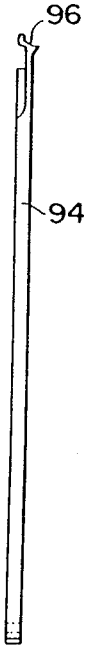
FIG. 11 is a side elevational view of the shell spacer shown in FIG. 10.
Figure 10:
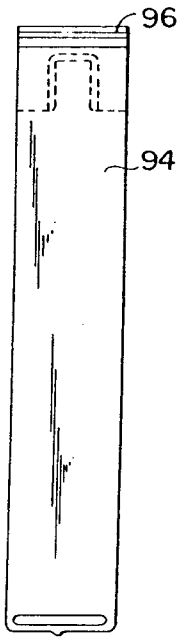
FIG. 10 is a front elevational view of a shell spacer.
Figure 12:
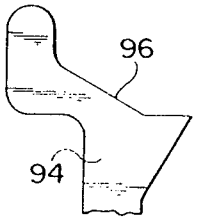
FIG. 12 is a somewhat enlarged fragmentary side elevational view of the upper end of the shell spacer.
Figure 9:
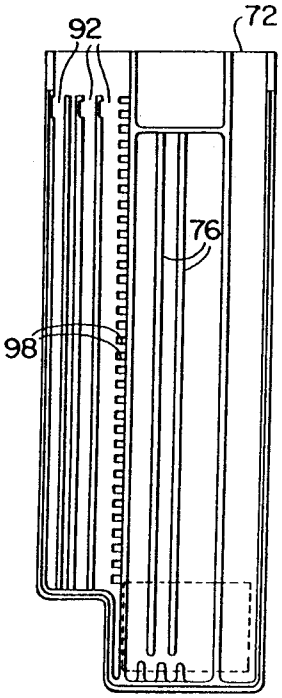
FIG. 9 is a sectional view taken along the line 9—9 of FIG. 7.

Considering now the firearm 10 in further detail, the magazine shroud 34 is preferably secured in fixed position to the receiver by threaded fasteners 40 (one shown in FIG. 1) and has a manually operable magazine catch 42 FIG. 5) for releasably securing a magazine therein, such as the box magazine 38. The magazine shroud 34 may be made from any suitable material, but preferably it is molded from a durable plastic material and has a plurality of parallel spaced apart and vertically extending ribs 44,44 which project both inwardly and outwardly from the opposite side walls thereof. A vertical series of small window openings 46,46 are formed through at least one sidewall of the magazine shroud, for a purpose for which will hereinafter be discussed.

Figure 2:
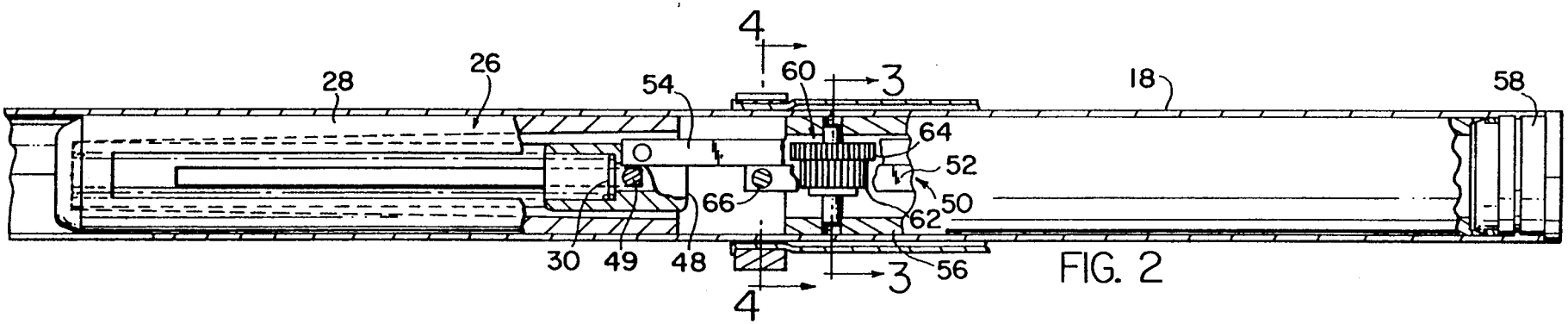
FIG. 2 is a somewhat enlarged fragmentary axial sectional view through the magazine tube of the shotgun of FIG. 1.

The hollow elongated tubular plunger 28, which comprises part of the plunger assembly 26, is slidably received within the magazine tube 18 and contains a generally cylindrical spring support member 48. The spring support member is retained within the plunger for limited axial sliding movement relative to the plunger by a pin 49 carried by the spring support member and which projects into a slot in the plunger. The plunger spring 30 is also contained within the plunger 28 and acts between the plunger and the spring support 48, substantially as shown in FIG. 2.

The plunger assembly 26 is connected to the action bar 24 by a rack and pinion mechanism indicated generally at 50 which includes a forearm rack 52 and a follower rack 54.

Figure 4:
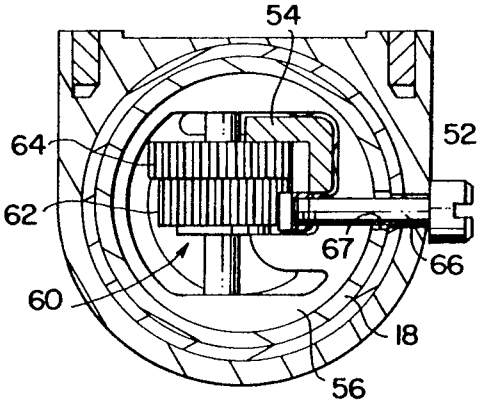
FIG. 4 is a somewhat enlarged sectional view taken along the line 4—4 of FIG. 2.
Figure 15:
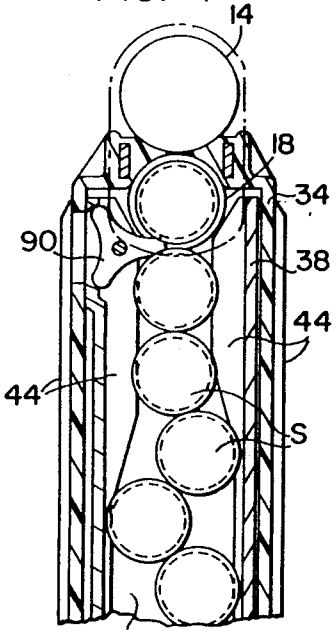
FIG. 15 is a somewhat enlarged fragmentary sectional view taken along the line 15—15 of FIG. 1.
Figure 3:
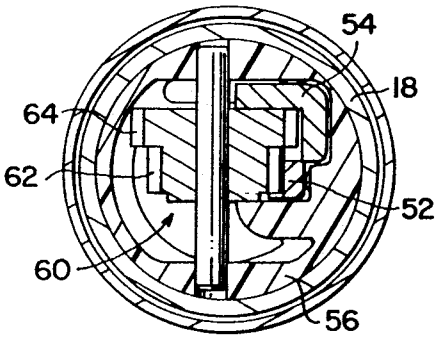
FIG. 3 is a somewhat enlarged fragmentary sectional view taken along the line 3—3 of FIG. 2.

The racks 52 and 54 are supported by and travel within guideways formed within a generally cylindrical rack housing 56 disposed within the forward end portion of the magazine tube 18 and retained therein by a magazine rack plug 58. A set of overdrive gears and pinion assembly indicated generally at 60 and journalled for rotation about a vertical axis within the rack housing 56, and best shown in FIGS. 2–4, includes a gear wheel 62 disposed in meshing engagement with the forearm rack 54 and another gear wheel or pinion 64 supported for coaxially rotation with the gear wheel 62 and disposed in meshing engagement with the follower rack 54. The rear end portion of the follower rack 54 is pinned to the spring support member 48 which comprises part of the plunger assembly. The rear end portion of the forearm rack 52 is connected to the action bar assembly by a threaded stud 66 which extends through the action slide tube, passes through an axially elongated slot 67 in the sidewall of the magazine tube, and is threadably engaged in the rear end portion of the forearm rack 54, 52 as shown in FIG. 4.

Figure 7:
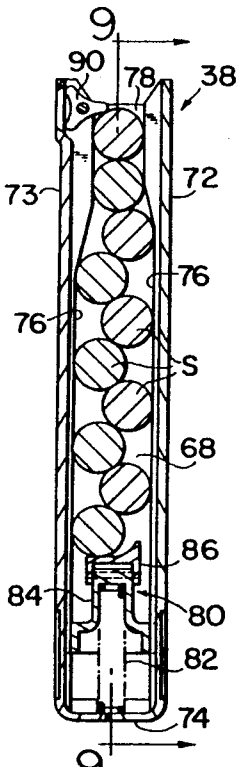
FIG. 7 is a sectional view taken along the line 7—7 of FIG. 6.
Figure 6:
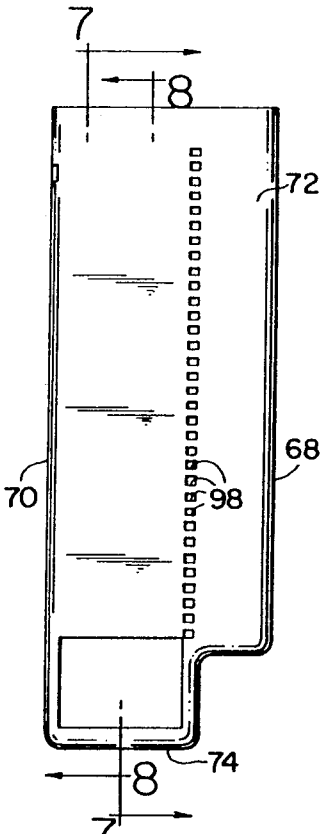
FIG. 6 is a side elevational view of the box magazine.
Figure 8:
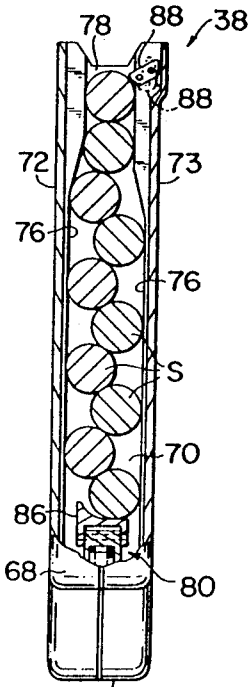
FIG. 8 is a sectional view taken along the line 8—8 of FIG. 6.

The illustrated box magazine 38 may be made from any suitable material, but a durable light weight plastic material is presently preferred for this purpose. The magazine has a generally rectangular housing, preferably formed by molded half sections, which includes a front wall 68, a rear wall 70, opposing sidewalls 72,73, and a bottom wall 74. The walls of the housing cooperate to define an opening at the upper end of the housing through which successive shells are received into and released from the magazine 38. The shells S,S used with the gun 10 are typical shotgun shells which have a generally cylindrical body and a rim the diameter of which is somewhat greater than the diameter of the shell body. The lateral width of the magazine is somewhat greater than the diameter of an associated shell which it is designed to receive. A plurality of parallel vertically extending ribs 76,76 formed on the inner surfaces of the sidewalls 72,73 engage the bodies of shells S,S stacked within the box magazine 38 and prevent the rims of the shells from engaging the magazine sidewalls so that the shells remain in substantially axially parallel alignment with each other within the magazine. Referring to FIGS. 7 and 8, it will be noted that the ribs 76,76 converge near the upper end of the magazine 38 to forming a guide channel 78 having opposing parallel walls defined by upper portions of the ribs 76,76 and a width substantially equal to the diameter of an associated shell body so that the shells, which may be stacked in generally laterally offset relation to each other in the lower portion of the magazine assume an axially parallel relationship to each other upon approaching the upper end of the magazine 38. Thus, each shell is guided along a substantially predetermined path as it leaves the magazine 38 to enter the shell receiving opening 32.

Shells are biased upwardly within the magazine 38 by a magazine follower assembly which includes a follower assembly 80 and an associated follower spring 82 which acts between the lower end of the magazine and the magazine follower assembly. The follower assembly 80 has a lower part 84 supported for vertical sliding movement within the magazine housing and an upper part or cradle 86 which is supported on the lower part by a pivot pin to pivot about a laterally extending axis relative to the magazine housing. The cradle has an upwardly open arcuate recess for complimenting an associated portion of a shell body. The pivoted cradle aides in preventing the stacked shells S,S from jamming within the magazine and assures smooth passage of shells therefrom.

A magazine latch 88 is provided for releasably retaining shells S,S in the magazine 38 when the magazine is removed from an associated gun such as the shotgun 10. The magazine latch is mounted at the upper end of the magazine and supported on the sidewall 73 for pivotal movement in counterclockwise direction from a shell retaining position of FIG. 8 to a shell releasing position shown in broken lines. The magazine latch 88 is spring biased toward its shell retaining position and engages the uppermost shell in the magazine 38 when the magazine is out of the magazine shroud 34 to releasably retain shells S,S in the magazine 38. A finger on the magazine shroud engages the magazine latch 88 to bias it to its shell releasing position when said box magazine 38 is fully positioned within the magazine shroud. A turnstile member 90 supported on the sidewall 72 near the upper end of the magazine for rotation about a generally horizontal axis operates to maintain spacing between the uppermost shell in the magazine and the shell immediately therebelow so that the rims of these adjacent shells will not attain a position of overlapping relationship relative to each other which could interfere with the loading of the firearm. The pivoted top plate on the magazine plunger prevents jamming of the shells which tend to attain a somewhat more random position relative to each other within the lower portion of the magazine.

The firearm of the present invention will fire shells which differ in length, as, example 2.75 inch, 3 inch, or 3.5 inch shells. For this reason the magazine is adjustable to accommodate shells which differ in length. A plurality of opposing guide tracks 92, 92 are formed on the inner surfaces of the sidewalls 72 and 73 near the front of the magazine 38 to receive a shell spacer 94 in a selected one of three possible positions. The shell spacer essentially comprises an elongated strip of material adapted to be slidably received within a selected one of the guide tracks. A resilient latch 96 at the upper end of the shell spacer 94 engages an associated recess in the selected guide track and releasably retains the spacer within the selected track to adapt the magazine to accommodate a shell of selected length.

Firearm 10 is loaded by inserting a loaded magazine into the magazine shroud. As the magazine attains its properly seated and latched position within the magazine shroud the magazine latch 88 moves to its releasing position thereby releasing the shells in the magazine allowing the uppermost shell to move upwardly past the turnstile 90 and into and through the shell receiving opening 32 and to its ready position within the magazine tube 18 in response to the biasing force applied to the stacked shells within the magazine by the magazine follower. The portions of the guide ribs 76, 76 at the upper end of the magazine direct the shell along a proper path into and past the turnstile 90 which controls movement of each successive shells 5 from the magazine housing into the gun and assures sufficient separation between the uppermost shell and the shell immediately therebelow so that the shell rims cannot attain an overlapping relationship to each other which could interfere with proper loading of the gun 10. Rearward movement of the forearm 23 causes a corresponding movement of the action bar assembly to move the breech bolt 20 from its battery toward and to its retired position. As the forearm moves to the rear the forearm rack 52 carried by the action bar assembly rotates the wheel and pinion assembly 60 in a clockwise direction, as viewed from below, causing rotation of the pinion 64 and rearward movement of the follower rack resulting in an accelerated movement of the plunger assembly 26 in the direction of the receiver 12. Thus, the plunger assembly 26 moves through a distance somewhat greater than the distance between the battery and retired positions of the breech bolt 20 as the breech bolt moves from its battery to its retired position. As a shell is moved from the ready position within the magazine tube 18 toward and into the receiver 12 by the plunger assembly 26 the shell is arrested by the shell stop (not shown), located within the receiver, before the breech bolt 20 attains its fully retired position. Thereafter the action bar assembly continues to move toward the rear imparting further motion to the rack follower 52 which causes compression of the plunger spring 30. The shell stop is released during the final portion of rearward movement of the breech bolt to its retired position which releases the shell and the plunger assembly. Upon release of the shell stop kinetic energy stored in the compressed plunger spring 30 moves the shell rearwardly within the receiver to its loading position therein.

During rearward movement of the forearm 23 the axially elongated plunger 28 passes over and substantially blocks the shell receiving opening 32 thereby preventing a shell from entering the magazine tube 18 from the box magazine 38.

Return movement of the forearm to its forward position moves the breech bolt 20 from its retired position to its battery position and returns the plunger assembly 26 to its position forward of the ready position. When the plunger assembly attains the latter position the uppermost shell in the box magazine 38 is moved upwardly through the shell receiving opening 32 and to the ready position within the magazine tube 18 in response to upwardly directed biasing force exerted by the magazine follower 80. The firearm 10 is now ready for loading in response to the next operation of the bolt actuating mechanism. If the box magazine 38 is removed from the magazine shroud 34 while a shell is in the magazine tube 18 the shell will fall freely from the magazine tube upon removal of the box magazine from the magazine shroud. A plurality of small window openings 98, 98 in the sidewalls of the box magazine permit visual inspection to determine the loaded status of the magazine. The window opening 98,98 in the upper portion of the magazine are in registry with associated windows 46,46 in the magazine shroud 34 when the box magazine 38 is properly secured within the magazine shroud and permit visual inspection to determine if there are shells in the box magazine.

I claim

1. A firearm having a receiver, a barrel attached to and projecting forwardly from said receiver, a bolt supported within said receiver for reciprocal movement between open and closed positions, a magazine tube attached to said receiver and projecting forwardly therefrom in generally parallel relation to said barrel, said magazine tube having an ammunition receiving opening through the wall thereof forward of said receiver, a plunger assembly disposed within said magazine tube and including a plunger and means for biasing said plunger in the direction of said receiver, magazine supporting means for attaching a box magazine containing a plurality of rounds of ammunition in fixed position relative to said firearm to feed a round of ammunition from the box magazine through said ammunition receiving opening and into said magazine tube and to a ready position wherein the round of ammunition is generally coaxially aligned with said magazine tube, bolt actuating means connected to said bolt within said receiver and moveable along said magazine tube for moving said bolt between its open and closed positions, and accelerating means attached to said plunger assembly and to said bolt actuating means for maintaining said plunger assembly in a position forward of said ready position when said breech bolt is in its closed position and simultaneously moving said plunger assembly through a distance greater than the distance traveled by said bolt in response to movement of said bolt actuating means, said accelerating means having a set of racks including a first rack connected to said bolt actuating means and a second rack connected to said plunger assembly and a set of overdrive gears including first and second gears supported for coaxial rotation in unison, said first gear being disposed in intermeshing engagement with said first rack, said second gear being disposed in intermeshing engagement with said second rack.

2. A firearm as set forth in claim 1 wherein said means for biasing said plunger comprises a spring disposed between said plunger and said second rack and biasing said plunger in a direction away from said second rack.

3. A firearm as set forth in claim 1 the further improvement wherein said action bar is disposed externally of said magazine tube and said first rack is connected to said action bar through a slot in said magazine tube.

4. A firearm as set in forth in claim 1 wherein said bolt actuating means comprises an action bar and said accelerating means is connected to said action bar and said plunger assembly.

5. A firearm as set forth in claim 4 wherein said action bar is disposed externally of said magazine tube and said accelerating means is disposed within said magazine tube and connected to said action bar through a slot in the wall of said magazine tube.

6. In a pump action firearm having a receiver, a barrel extending in a forward direction from the receiver, a magazine tube extending from the receiver in generally axially parallel relation to the barrel, and a forearm supported for forward and rearward reciprocal movement along the magazine tube the improvement comprising accelerating means for simultaneously moving another part of the firearm in a rearward direction response to rearward movement of said forearm and through a distance substantially greater than the distance moved by said forearm and including a first rack connected to said forearm to move therewith, a second rack connected to said other part and a set of overdrive gears supported for rotation in unison about an axis fixed relative to said magazine tube, said overdrive gears including a first gear disposed in intermeshing engagement with said first rack and a second gear disposed in intermeshing engagement with said second rack for moving said second rack in response to movement of said first rack.

7. In a pump action firearm as set forth in claim 6 the further improvement wherein said first rack, said second rack and said set of overdrive gears are disposed within said magazine tube and said first rack is connected to said forearm through an opening in said magazine tube.

8. In a pump action firearm as set forth in claim 7 having a plunger supported for movement within and along said magazine tube the further improvement wherein said plunger is connected to said second rack.

9. In a pump action firearm having a receiver, a barrel connected to and extending forwardly from the receiver, a magazine tube connected to the receiver and extending forwardly therefrom in parallel relation to the barrel and communicating with the interior of the receiver, a plunger supported for reciprocal movement within the magazine tube and therealong, a breech bolt supported within the receiver for movement between battery and retired positions, and action bar means for moving the breech bolt between its battery and retired positions and including a forearm supported for reciprocal forward and rearward along the magazine tube and an action bar connecting said breech bolt to said forearm to move in response to the movement of the forearm, the improvement comprising said magazine tube having an opening through the wall thereof forward of the receiver, means for supporting a box type magazine on said shotgun to feed a round of ammunition through said opening and to a loading position within said magazine tube, and accelerating means connected to said forearm and to said plunger assembly for maintaining said plunger assembly in a first position forward of said loading position when said breech bolt is in its battery position and for and moving said plunger through a distance substantially greater than the distance traveled by said forearm in moving said breech bolt from its battery to its retired position and having a set of overdrive gears including a gear, a pinion, and means for supporting said gear and pinion for coaxial rotation in unison within said magazine tube and about an axis extending transversely of said magazine tube, and a set of racks including a first rack connected to said action bar and in meshing engagement with said gear, and a second rack connected to said plunger and disposed in meshing engagement with said pinion.

10. In a firearm as set forth in claim 9 the further improvement comprising a plunger spring for urging said plunger in the direction of said receiver.

11. A firearm having a receiver, a barrel attached to and projecting forwardly from the receiver, a bolt supported within the receiver for reciprocal movement between open and closed positions, a magazine tube attached to the receiver and projecting forwardly therefrom in generally parallel relation to the barrel, the magazine tube having an opening through the wall thereof forward of the receiver, a plunger assembly disposed within the magazine tube and including a plunger and means for biasing the plunger in the direction of the receiver, bolt actuating means connected to the bolt within the receiver for moving the bolt between its open and closed positions, a box magazine, magazine supporting means for attaching said box magazine in fixed position to said firearm to feed a round of ammunition through said ammunition receiving opening and into said magazine tube and to a ready position wherein the round of ammunition is generally coaxially aligned with said magazine tube, and accelerating means connected to said plunger assembly and to said bolt actuating means for maintaining said plunger assembly in a position forward of said ready position when said breech bolt is in its battery position and for moving said plunger assembly through a distance greater than the distance moved by said bolt in response to the operation of said bolt actuating means and including a set of overdrive gears and a set of racks, each of said racks intermeshing with an associated one of said gears overdrive gears, one of said racks being connected to said bolt actuating means, another of said racks being connected to said plunger assembly.

* * * * *